US006367189B1

(12) United States Patent
Clay

(10) Patent No.: US 6,367,189 B1
(45) Date of Patent: Apr. 9, 2002

(54) NON-PROTRUDING AIMING APPARATUS FOR HANDGUNS

(76) Inventor: David Richard Clay, 107 Colony Dr., Arlington, TX (US) 76001

( * ) Notice: Subject to any disclaimer, the term of this patent is extended or adjusted under 35 U.S.C. 154(b) by 0 days.

(21) Appl. No.: 09/543,179

(22) Filed: Apr. 5, 2000

(51) Int. Cl.[7] ..... F41G 1/32

(52) U.S. Cl. ..... 42/145; 42/111; 42/132; 42/144

(58) Field of Search ..... 42/132, 111, 145, 42/144

(56) References Cited

U.S. PATENT DOCUMENTS 3,641,676 A * 2/1972 Knutsen et al. ..... 42/136
3,698,092 A * 10/1972 Rosenhan ..... 42/132
4,628,611 A * 12/1986 Ruffino ..... 42/137
4,713,889 A * 12/1987 Santiago ..... 42/132
5,065,519 A 11/1991 Bindon ..... 33/241
5,878,521 A * 3/1999 Warnock ..... 42/145
6,058,615 A * 5/2000 Uhlmann et al. ..... 42/132
6,068,483 A * 5/2000 Minor ..... 434/19
6,216,351 B1 * 4/2001 Flubacher et al. ..... 42/132
6,233,836 B1 * 5/2001 Uhlmann et al. ..... 42/132

* cited by examiner

*Primary Examiner*—Charles T. Jordan
*Assistant Examiner*—John W. Zerr
(74) *Attorney, Agent, or Firm*—Bracewell & Patterson, LLP

(57) ABSTRACT

A groove is provided on an upper surface of a handgun slide, wherein the groove is enclosed on one end and open at the rear end of the slide. The groove, beginning at a predetermined point along the top and extending rearward to the end of the slide, has a front face and a rear opening. A small cylinder of tritium activated phosphor is installed in the front face of the groove and is longitudinally parallel to the device so that the end of the cylinder is visible to a holder of the device. Additionally, a second small cylinder of tritium activated phosphor is installed just below the rear opening of the groove. The second cylinder is parallel to the bottom of the rear opening so that the length of the cylinder is visible to the holder. Sighting is accomplished by aligning the first cylinder end with the bottom of a target and aligning the second cylinder length with the bottom of the first cylinder end in the standard "six o'clock" sighting position.

15 Claims, 3 Drawing Sheets

NON-PROTRUDING AIMING APPARATUS FOR HANDGUNS

BACKGROUND OF THE INVENTION

1. Technical Field

The present invention relates in general to the field of sights for aiming or aligning devices and in particular to aiming handguns. More particularly, the present invention relates to sights that are non-protruding and can be used in all lighting conditions.

2. Description of the Related Art

A variety of sighting devices are known for orienting devices that need to be aimed. Although the present invention is applicable to various such situations, it will be discussed primarily with respect to the problem of aiming handguns and similar weapons. Firearms and the like typically have two sights that are spaced apart from one another along a line substantially parallel to the path along which a projectile will be discharged by the weapon. A user holds the firearm so as to view over and/or through the two spaced sights toward the target, before discharging the weapon. The object is to align the weapon accurately to the target by viewing along a line to the target and holding the weapon along that line as defined by the spaced sights.

The state of the art of present day sights includes the open or "iron" sight. The typical open or iron sight is by far the most commonly used for handguns and rifles. Typically an iron sight has a front sight comprising a blade member at the extreme front or muzzle end of the weapon. The blade member is usually rectangular in cross section and appears to the user as a thin solid block on the top surface of the barrel in line with a FIG. 3 depicts a perspective of atypical semi-automatic handgun slide 302 with sights 304, 306. Slide 302 is a portion of the weapon that encloses the barrel and is used to arm the handgun preparatory to firing. Handgun 300 is shown with grip 310, trigger 309 and trigger guard 311 shown in phantom view. Slide 302 has a front or muzzle end 303 and a rear end 308 shaped to receive a hammer (not shown) when the hammer is released by trigger 309. Rear sight 304 is shown mounted on the rear of slide 302 and front sight or blade 306 is shown mounted on the front or muzzle end of slide 302.

Rear sight 304 is usually disposed at the rear of the slide, and typically comprises a planar member having an open rectangular notch extending downward from a horizontal edge at the top periphery of the planar member. Rear sight 304 maybe along the barrel or over the chamber portion of the weapon, proximate to the shooter. To aim the weapon, a shooter aligns the top of front sight blade 306 with the bottom of the target. The weapon is adjusted as to elevation by setting the top edge of front sightblade 306 even with the top of the notch of rear sight 304. The weapon is aligned laterally by centering front sight blade 306 in the notch of rear sight 304. The intended target should appear just against the top of front blade 304. This method of aiming is called the "six o'clock" method of aiming.

As described above, the iron sight protrudes from the weapon. In target handguns, protruding sighting devices are usually not a problem. However, in a handgun designed for protection or immediate availability, protruding sights pose a problem. Handguns that are designed to be carried in a pocket, holster or purse must be easy to remove from the carrier. Protruding sights on this type of weapon may interfere with the drawing of the weapon by snagging or catching on material of the holding receptacle (pocket, holster, etc.). Automatic and semiautomatic handguns install sights on an upper surface of the weapon, usually on top of the slide. A blade sight on the front of the barrel near the muzzle may interfere with swift retrieval of the weapon by catching on the holder material. To improve the retrieval of the weapon, the sighting components are usually reduced in size and rounded to diminish the chances of catching the barrel on material. However, even the sights that are reduced in size catch on material.

It would be desirable, therefore, to provide a sighting mechanism that would eliminate the need for a front blade sight and a rear sight and allow for a smooth, rounded muzzle. Additionally, it would be desirable to eliminate the need for a protruding rear sight and allow a smooth, rounded slide component of a handgun.

SUMMARY OF THE INVENTION

It is therefore one object of the present invention to provide a sighting mechanism that does not protrude from a slide of a handgun and will provide proper alignment when being aimed.

It is another object of the present invention to provide a sighting mechanism that allows for sighting the device in all lighting conditions.

The foregoing objects are achieved as is now described. A groove is provided on an upper surface of a pistol slide wherein the groove is enclosed on one end and open at the rear end of the slide. The groove, beginning at a predetermined point along the top and extending rearward to the end of the slide, has a front face and a rear opening. A small cylinder of tritium activated phosphor is installed in a hole drilled in the front face of the groove and is longitudinally parallel to the slide so that the round end of the cylinder is visible to a holder of the pistol. Additionally, a second small cylinder of tritium activated phosphor is installed just below the rear opening of the groove. The second cylinder is parallel to the bottom of the rear opening so that the length of the cylinder is visible to the holder. Sighting is accomplished by aligning the first cylinder end with the bottom of a target and aligning the glowing second cylinder length with the bottom of the first cylinder end in the standard "six o'clock" sighting position.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
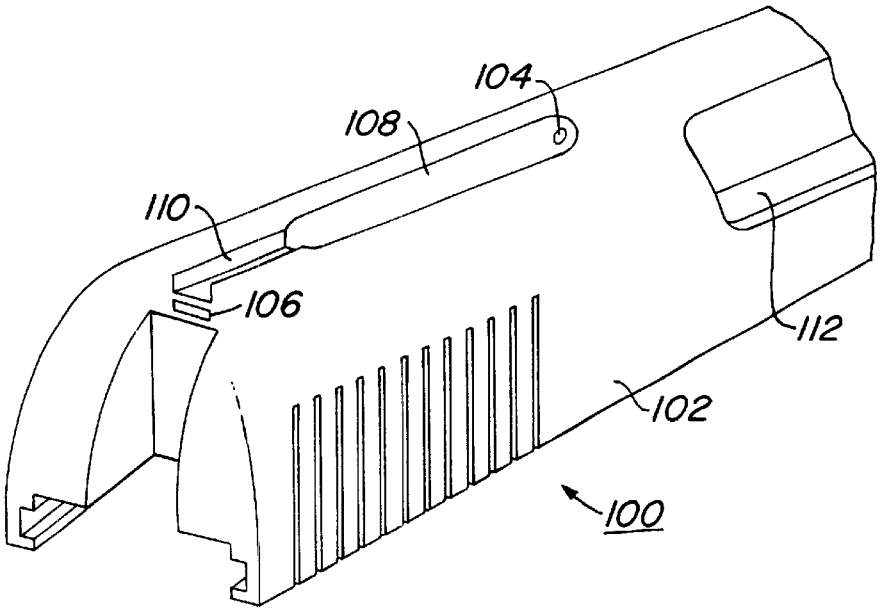
FIG. 1 depicts a perspective of a slide of a handgun in which a preferred embodiment of the present invention may be implemented.
Figure 3:
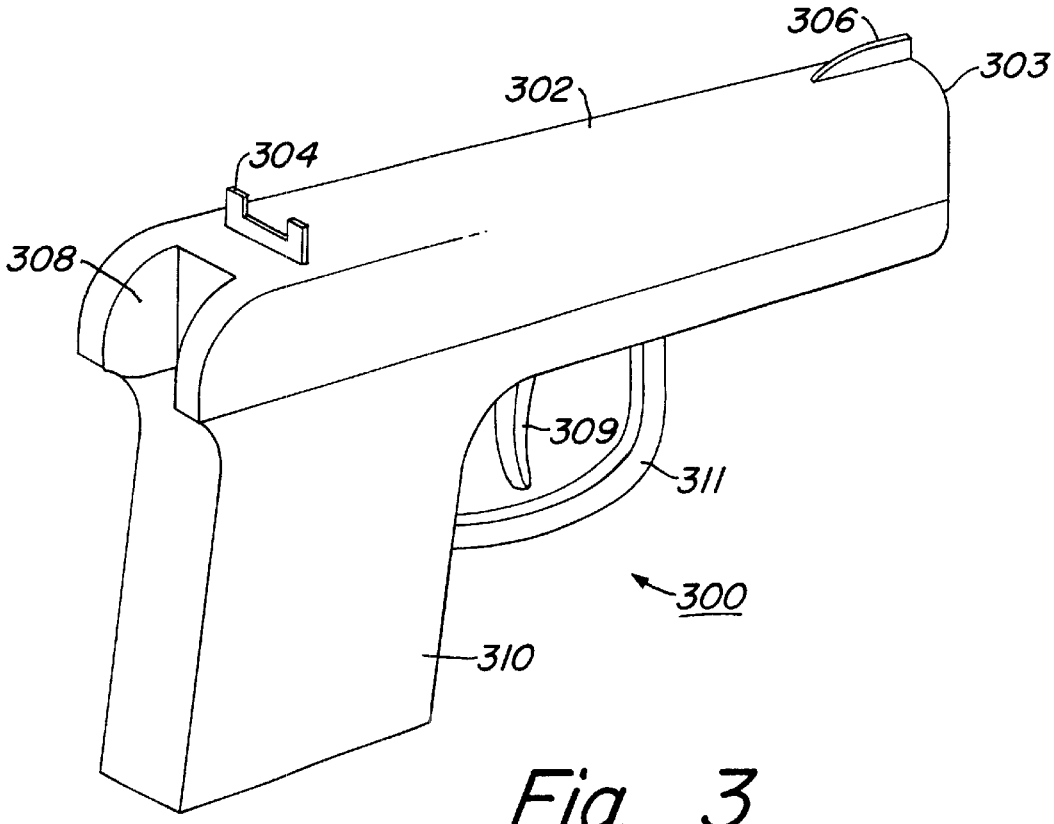
Fig. 3 (PRIOR ART)
FIG. 3 depicts a perspective of a typical handgun slide with an iron sight.

With reference now to the figures, and in particular with reference to FIG. 1, a perspective of a handgun slide in which a preferred embodiment of the present invention may be implemented, is depicted. Slide 100 is comprised of body 102, ejection slot 112, a first tritium cylinder 104, gutter 108 and connecting gutter 110 and a second tritium cylinder 106. Slide 100 is the arming mechanism of a semi-automatic handgun. Ejection slot 112 provides an opening through which expended casings are automatically ejected after being fired. Slide 100 is mounted on top of the firing mechanism of a handgun (not shown) and is utilized for arming and aiming the handgun.

First tritium cylinder 104 is installed longitudinally in a drilled hole in a forward face of gutter 110 leaving an end of first tritium cylinder 104 open. Tritium cylinder 104 is comprised of a glass cylinder encased by a clear plastic covering and contains Tritium (radioactive isotope of hydrogen). The Tritium inside tritium cylinder 104 reacts with a phosphor coating on the inside of the glass cylinder, causing the cylinder to glow. First tritium cylinder 104 has only one end exposed and the visible appearance of tritium cylinder 104 is round, the exposed end facing rearward. First tritium cylinder 104 replaces the standard blade sight that is typical on most slides. Additionally, the glowing phosphor provides good visibility of a front sight in low light conditions.

Second tritium cylinder 106 is disposed on the rear end of slide 102 in a slot that is horizontally perpendicular to first tritium cylinder 104. Second tritium cylinder 106 replaces the rear sight in a typical iron sight configuration. Also, as second tritium cylinder 106 glows, the rear sight is provided with good visibility in low light conditions.

Figure 2A:
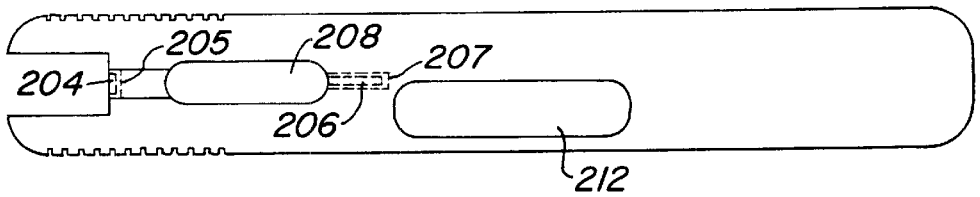
FIGS. 2A–2B illustrate a rear view and a side view of a slide of a handgun in which preferred embodiments of the present invention may be implemented.
Figure 2A:
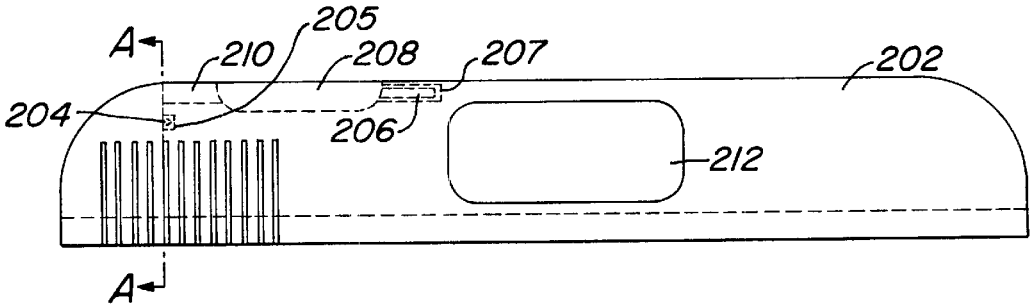
Figure 2A:
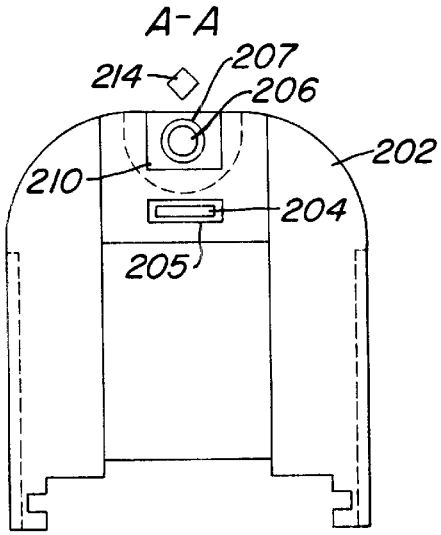
Figure 2B:
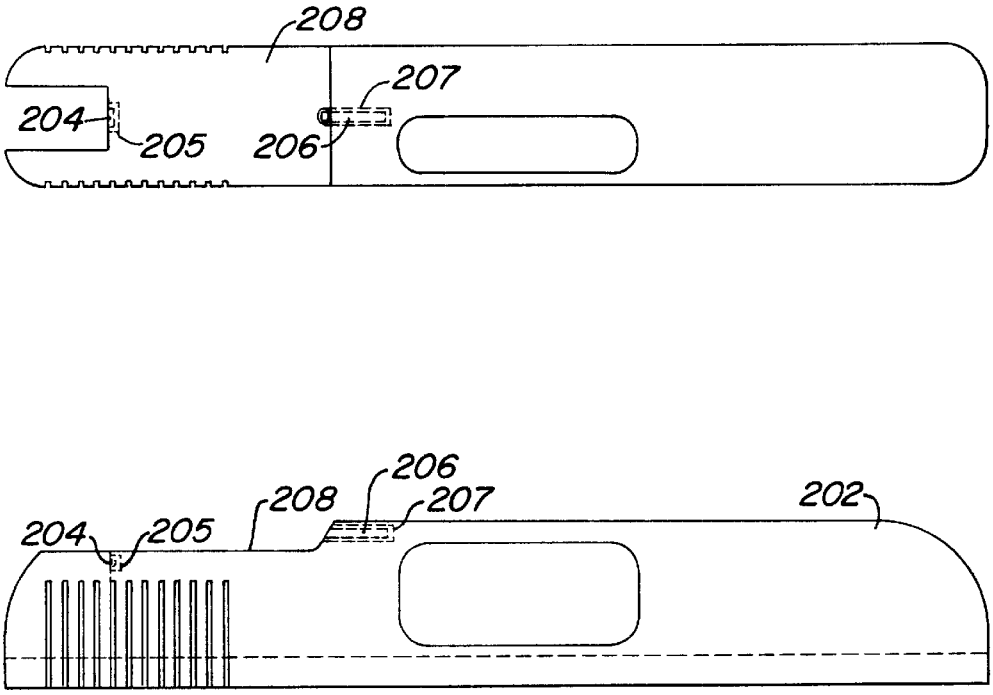
Figure 2B:
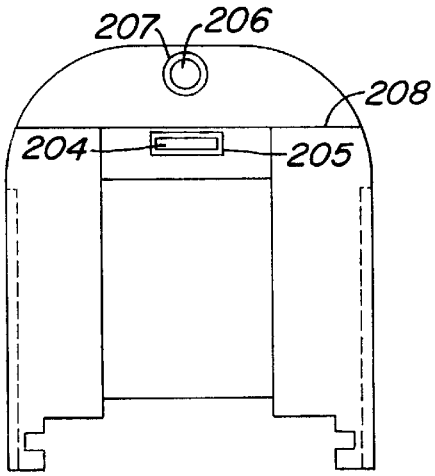

The front and back sights, as shown in FIG. 2A and FIG. 2B, are visible in the dark due to the tritium-phosphor reaction. Tritium coated sights are well known in the art and are used for sighting at night and low light conditions on all types of firearms. Additionally, since the two components of a sighting device are located below the top surface of a slide, the slide may be manufactured with a rounded, smooth muzzle and a rounded, smooth rear end. This style of construction provides little or no edges, on the slide, to snag material and inhibit fast retrieval of the handgun.

Though the present invention is depicted as having a rectangular shaped notch (open end of the groove), the shape of the notch is not required to be rectangular and could be any shape that facilitated aiming, including a semi-circular notch or a "V" shaped notch. The included tritium cylinders utilized for low light condition aiming may be installed in one of many arrangements, including: tritium cylinders arranged providing a rectangular outline as a rear sight; a V-shaped outline or a plurality of tritium cylinder ends forming different arrangements of visible dots, etc. In other words, tritium cylinders may be arranged to mimic many, if not all, standard sighting devices presently available.

Referring now to FIG. 2A, a rear view, a side view and a top view of a handgun slide in which a preferred embodiment of the present invention may be implemented, is illustrated. Slide 202 is shown in rear view A—A, depicting second tritium cylinder 204 horizontally disposed in slot 205 beneath rectangular slot 210. Immediately above the floor of rectangular slot 210, installed in a face at the end of a second rounded slot 208, is first tritium cylinder 206 installed so that only an end of first tritium cylinder 206 is visible through rectangular slot 210.

Top and side views of slide 202 are depicted with horizontal slot 205 containing second tritium cylinder 204. Rectangular slot 210 is shown intersecting rounded slot 208. Longitudinal hole 207 is drilled into the front face of rounded slot 208 and contains first tritium cylinder 206. Sighting is accomplished by lining up the bottom of target 214 with the top of first tritium cylinder 206 and positioning first tritium cylinder 206 between the vertical walls of rectangular slot 210 and above second tritium cylinder 204. As the handgun is fired, slide 202 automatically ejects a spent cartridge through ejection aperture 212 and cocks the handgun for another firing.

A light colored band is positioned around the end of first tritium cylinder 206 providing a circular front sight that is visible during daylight conditions. The light colored band is positioned for aiming similar to the manner first tritium cylinder 206 is positioned during low light or night time conditions; between the walls and above the floor of rectangular slot 210. This provides a typical six o'clock aiming position during daytime when the tritium is not as visible.

Referring to FIG. 2B, another example in which a preferred embodiment of the present invention maybe implemented is illustrated. Slide 202 is shown in a top view, a side view and a rear view. First tritium cylinder 206 is shown installed in slot 207, and second tritium cylinder 204 is installed in slot 205. Cutaway 208, as shown, is flat and extends from just below slot 207 to the rear of slide 202. Even though second tritium cylinder 204 is shown in a horizontal configuration, different arrangements utilizing more than one cylinder may be employed to form a rear sight.

While the invention has been particularly shown and described with reference to a preferred embodiment, it will be understood by those skilled in the art that various changes in form and detail may be made therein without departing from the spirit and scope of the invention.

What is claimed is:

1. In a handgun having a slide, an aiming system comprising:

a recessed area in an upper surface of the slide, the recessed area extending rearward from a forward portion of the recessed area to a rear end of the slide;

a first sighting element located in the forward portion of the recessed area and below the upper surface of the slide; and a second sighting element located in the rear end of the slide and below a rear portion of the recessed area.

2. The handgun of claim 1, wherein:

the recessed area begins at a position rearward of a front end of the slide, the forward portion of the recessed area forming an inclined portion; and the first sighting element is located on the inclined portion.

3. The handgun of claim 1, wherein:

the recessed area is a longitudinal groove extending parallel to the length of the slide and being bisected by a vertical, central plane that bisects the slide.

4. The handgun of claim 3, wherein:

the groove comprises a forward section and a rearward section, the forward section having a smooth, semi-circular lateral cross-section, the rearward section having a rectangular, U-shaped lateral cross-section.

5. The handgun of claim 3, wherein:

the first sighting element is located above a lower surface of the rearward section of the groove and is bisected by the central plane; and the second sighting element is bisected by the central plane.

6. The handgun of claim 1, wherein:

the recessed area is a flat, generally-planar, horizontal section extending rearward from the forward portion of the recessed area to the rear end of the slide and extending laterally to sides of the slide.

7. The handgun of claim 6, wherein:

the first sighting element is located above the horizontal section and is bisected by a vertical central plane that bisects the slide; and the second sighting element is bisected by the central plane.

8. A slide for a handgun, the slide comprising:

an integral groove in an upper surface of the slide, the groove extending from a forward portion of the groove to a rear end of the slide, the groove extending parallel to the length of the slide and being bisected by a vertical, central plane that bisects the slide;

a first sighting element located in the forward portion of the groove above a lower surface of the groove and is bisected by the central plane, the first sighting element being below the upper surface of the slide; and a second sighting element located in the rear end of the slide and below a rear portion of the groove, the second sighting element being bisected by the central plane.

9. The slide of claim 8, wherein:

the groove has a forward section and a rearward section, the forward section having a greater width than the rearward section.

10. The slide of claim 8, wherein:

the groove has a forward section and a rearward section, the forward section having a smooth, semi-circular lateral cross-section, the rearward section having a rectangular, U-shaped lateral cross-section.

11. The slide of claim 8, wherein:

the first sighting element and the second sighting element are formed of luminescent material, and wherein the second sighting element comprises a horizontal bar.

12. The slide of claim 8, wherein:

the first sighting element comprises a cylinder of luminescent material having an axis aligned parallel with a length of the groove; and the second sighting element comprises a cylinder of luminescent material having an axis aligned perpendicular to a length of the groove.

13. In a handgun having a slide, an aiming system comprising:

a recessed area in an upper surface of the slide, the recessed area having at a forward end a rearward facing shoulder, the recessed area extending rearward from the shoulder to a rear end of the slide;

a first sighting element, the first sighting element being a cylinder of luminescent material located in a cavity formed in the shoulder of the recessed area below the upper surface of the slide, the cylinder having an end that faces rearwardly; and a second sighting element located at the rear end of the slide and below a rear portion of the recessed area, the second sighting element being a cylinder of luminescent material aligned perpendicular to the first sighting element.

14. The handgun of claim 13, wherein:

the recessed area comprises a longitudinal groove extending parallel to the length of the slide and being bisected by a vertical, central plane that bisects the slide.

15. The handgun of claim 14, wherein:

the groove comprises a forward section and a rearward section, the forward section having a smooth, semi-circular lateral cross-section, the rearward section having a rectangular, U-shaped lateral cross-section.

* * * * *